United States Patent [19]

White

[11] Patent Number: 4,928,856

[45] Date of Patent: May 29, 1990

[54] BOTTLED WATER DISPENSING SYSTEM

[76] Inventor: Jonathan Z. White, 2208 Falcon Hill Pl., Lynchburg, Va. 24503

[21] Appl. No.: 160,353

[22] Filed: Mar. 3, 1988

Related U.S. Application Data

[63] Continuation-in-part of Ser. No. 25,210, Mar. 11, 1987, abandoned.

[51] Int. Cl.[5] ..... B67D 3/00

[52] U.S. Cl. ..... 222/174; 222/181; 222/481; 222/507; 222/509; 222/525; 222/545; 248/311.3; 215/237

[58] Field of Search ..... 222/174, 180, 181, 185, 222/481, 479, 507, 509, 525, 490, 494, 545, 482, 478, 481.5, 522, 523; 248/311.2, 311.3; 137/860; 24/69 R, 69 CF, 69 T, 69 AT; 215/237, 239, 240, 241, 242, 272, 280, 284, 285, 286

[56] References Cited

U.S. PATENT DOCUMENTS

| | | | |
|---|---|---|---|
| 281,608 | 7/1883 | Browne | 222/545 X |
| 1,555,911 | 10/1925 | Cockrell | 222/174 X |
| 2,056,863 | 10/1936 | Napier | 222/185 |
| 2,239,921 | 4/1941 | Mueller | 222/181 X |
| 2,337,276 | 12/1943 | Sanchis | 222/481 X |
| 2,593,634 | 4/1952 | Vosburg | 222/525 X |
| 2,605,021 | 7/1952 | Churchill et al. | 222/181 X |
| 2,658,648 | 11/1953 | Tribbitt | 222/181 X |
| 2,682,339 | 6/1954 | Ferris | 248/311.3 X |
| 2,742,194 | 4/1956 | Brown | 222/181 X |
| 2,858,052 | 10/1958 | Costakos | 222/185 |
| 4,573,653 | 3/1986 | Boettger | 248/311.2 X |
| 4,722,463 | 2/1988 | Anderson | 222/509 X |
| 4,725,027 | 2/1988 | Bekanich | 248/311.3 X |

FOREIGN PATENT DOCUMENTS

| | | | |
|---|---|---|---|
| 178294 | 4/1954 | Austria | 215/272 |
| 847957 | 6/1952 | Fed. Rep. of Germany | 248/311.3 |
| 2812630 | 10/1978 | Fed. Rep. of Germany | 215/237 |
| 30318 | 2/1904 | Switzerland | 248/311.3 |

*Primary Examiner*—Joseph J. Rolla
*Assistant Examiner*—Stephen B. Parker

[57] ABSTRACT

A dispensing system for bottled water, having a vented fluid dispenser assembly secured to the neck of a bottle which is inverted and supported by a bracket. The vent tube extends inward through the fluid to near the bottle bottom and ends with a check valve. A concentric valve member located within a flow tube seals against a valve seat and is manipulated by the reciprocating motion of a sleeve which surrounds the flow tube. The valve member is shaped with varying diameters, to regulate flow rate as a function of its elevation relative to the valve seat. The outer end of the valve member is releasably fastened to the sleeve center. A number of ways of assembling the fluid dispenser assembly to a bottle are provided for in this patent, including a sliding yoke, a clamping slide, and a swinging clasp, each of which has means for urging the dispenser assembly into sealing contact with the bottle mouth by gripping the outside of the neck, and in addition there are plug securing means, each adapted to compress a deformable plug within the bottle neck. A container support is used to securely support a five or six gallon bottle in an inverted position allowing easy insertion, use and removal.

12 Claims, 3 Drawing Sheets

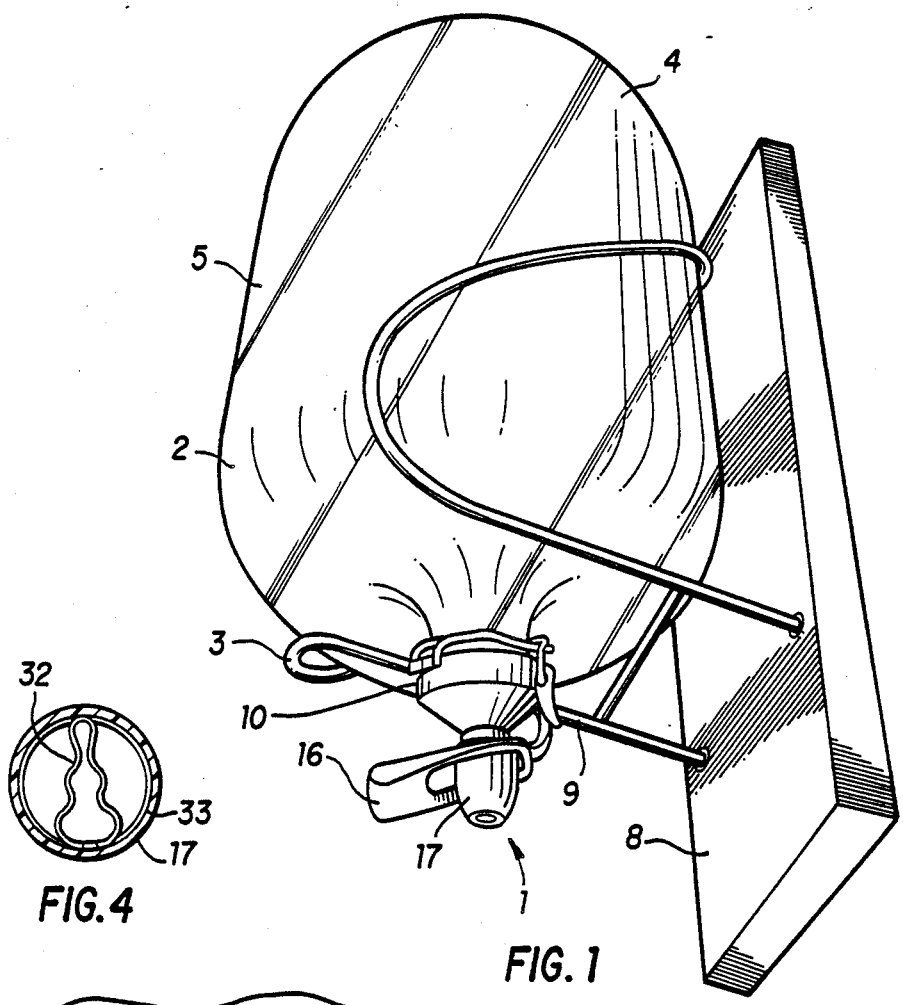
FIG. 1
FIG. 4
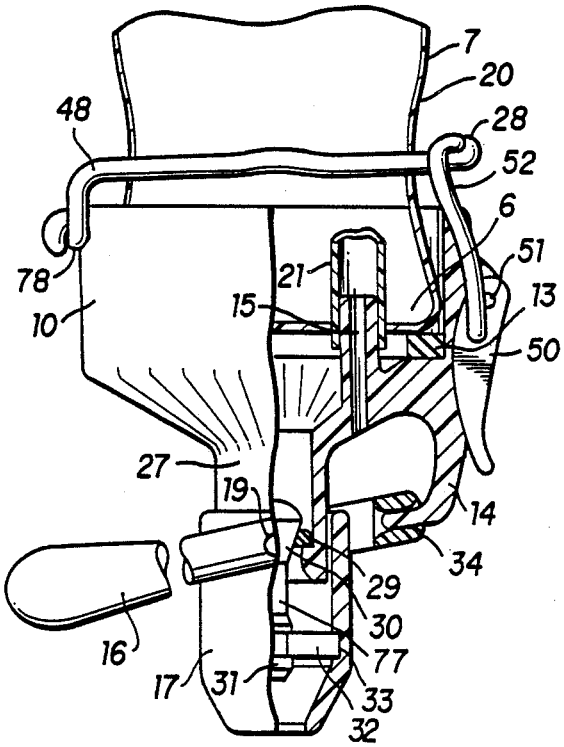
FIG. 2
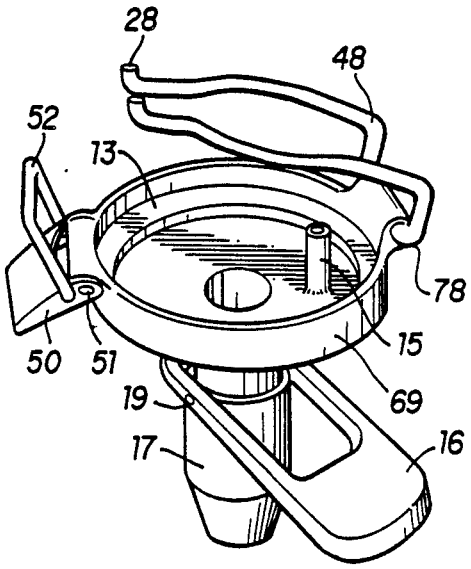
FIG. 3

BOTTLED WATER DISPENSING SYSTEM

This application is a continuation-in-part of application Ser. No. 07/025,210 filed Mar. 11, 1987, now abandoned.

BACKGROUND OF THE INVENTION

1. Field of the Invention

This invention relates to bottled water dispensing systems, and more specifically, to the combination of a valve to be attached to the bottle mouth and a supporting bracket to suspend the bottle in an inverted position.

2. Description of the Prior Art

The common bottled water dispenser in use today is a box-like device, designed to rest on the floor and support a five or six gallon bottle of drinking water. Typically, a button is pushed to dispense water into a cup. A certain amount of floor space is required by this device, and little choice is available to the user regarding shape or style.

The present invention will allow independent attachment of a dispensing valve to the water container, which is then suspended on a wall bracket or a floor stand, as the user desires. The dispenser may be more easily and conveniently cleaned, as often as the bottle is changed, to ensure water purity.

Ease of dispensing is improved by the present invention, wherein a handle is raised to initiate water flow and to regulate its rate.

SUMMARY OF THE INVENTION

The purpose of this invention is to free floor space by suspending a drinking water bottle inverted in a wall-mounted bracket.

An object of this invention is to provide a dispensing valve which is housed in a closure cap, which cap is secured to a bottle by means of a transversely sliding yoke straddling a neck annulus.

A further object is to provide a valve actuating device, consisting of a sleeve around a flow tube, the sleeve fleibly fastened to a coaxial valve member, and pivotally attached to a handle.

Another object is to provide a dispensing valve that is actuated by a coaxial vent tube, passing through a valve member.

A feature of the invention is the simplicity and economy of construction of the support bracket.

A further feature is a supporting structure that can be either wall mounted or free standing, with a minimum of alteration.

Another feature is the straightforward simplicity of the closure attachment mechanism.

Another object of this invention is to provide smooth flow by means of a sleeve, whose inner diameter is constricted toward the exit end.

Still another object is to provide a clearance for the entry of air between the sleeve upper end and the flow tube, so that when the valve is fully closed, remaining water in the sleeve will easily and quickly drain.

A further object is the provision of a wall mounted bracket of strength and simplicity in which the inverted bottle may be placed and removed with relative ease, and allowing unrestricted access to the dispenser valve.

One embodiment of this invention includes a closure means comprising a U-shaped clasp of heavy wire, centrally pivoted at its base on one edge of the dispenser cap, two free ends being drawn together around the neck annulus, and downward at the opposite edge of the cap by an over-center clip.

Another embodiment has a yoke adapted to slide transversely through parallel openings in a closure cap, compressing by its movement the bottle mouth against a gasket.

A similar version has a clamping slide, adapted to draw the bottle mouth against a gasket by gripping the neck annulus and the dispenser cap as a function of transverse motion.

Still another embodiment uses a plug with a cam for compressing the plug in the bottle neck, securely attaching and sealing the dispenser valve to the bottle.

Other objects, features and advantages of the present invention will become apparent from the following description and claims, when taken in conjunction with the accompanying drawings forming a part hereof, wherein like numerals refer to like parts throughout.

BRIEF DESCRIPTION OF THE DRAWINGS

FIG. 1 is a perspective view of the preferred embodiment of the present invention, the fluid dispenser shown attached to an inverted container which is supported by a bracket.

FIG. 2 is a partial section in elevation showing the mechanism of the preferred embodiment.

FIG. 3 is a perspective view of the preferred dispenser version with swinging clasp.

FIG. 4 is a detail view of the retainer clip shown in FIG. 2.

DESCRIPTION OF THE PREFERRED EMBODIMENTS

Figure 7:
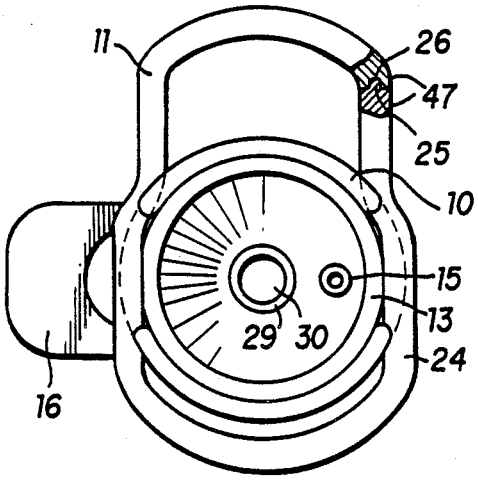
FIG. 7 is a plan view showing the geometry of the closed yoke.

Referring to FIG. 1 of the drawings, reference numeral 1 indicates a dispenser assembly mounted on a container 2, supported in the inverted position on a bracket 3 made up of a base 8 and curved support members 9, securely attached to the base near the bottom and again centrally near the top behind the container wall 5. The support members extend horizontally from the base, as shown, to provide supporting means on either side of container neck 7, and curve upward and outward to correspond with bottle shape, while allowing an unobstructed path for the insertion and removal of the container. FIG. 2 shows cap 10 surrounding the container mouth 6 which is pressed into contact with a gasket 13, itself supported by a concentric and perpendicular shoulder 12. Shown here and in FIG. 3 is the preferred embodiment of this invention wherein mouth 6 and cap 69 are held in sealing proximity by means of a clasp 48, U-shaped and resilient, surrounding the neck at annulus 20, pivotally fixed transversely at its base 78 on one edge of the cap. Clasp ends 28 are adapted to engage with over-center clip 50 by means of bail 52 so that the clasp ends 28 are held together when the clip is swung around clip pivot 51 into the over-center clasped position.

A vent tube 21 leads from ambient atmosphere by way of a vent stub 15 attached to the inside of the cap 10, with air passages connecting to the outside, to a check valve 23 which is located near the container bottom 4.

A cutaway view in FIG. 2 shows a preferred arrangement for the dispenser mechanism, consisting of a central valve member 30, urged firmly into sealing contact with valve seat 29 by the weight of valve handle 16, the force of which is multiplied by the relative proximity of sleeve pivot pin 19 to pivotal end 34, and transmitted to valve member 30, through sleeve 17, whose weight itself adds a measure of force to the total, and finally to the valve member by means of a flexible coupling fixed central to the sleeve, in this embodiment a retainer clip 32, which securely grips valve member 30 at the circumferential groove 31 in the attached stem 77.

The retainer clip 32, which is shown in detail by FIG. 4, is either cast in place or securely snapped into an annular groove 33 in the inner wall of sleeve 17, with an off-center opening in the clip large enough to axially admit passage of the stem with circumferential groove to a position of alignment corresponding to the retainer clip so that when the stem is forced transversely into engagement with the retainer clip, it is held central to the sleeve and is fixed in axial position.

As is evidenced by the drawings, retainer clip 32 transmits vertical forces from sleeve 17 to stem 77. As valve handle 16 is raised, valve member 30 is lifted from sealing contact with valve seat 29, allowing liquid to flow from container 2 by gravity. Further lifting increases flow area between valve member and valve seat.

Sufficient diametral clearance is provided between flow tube and sleeve so that as the valve member is returned to sealing contact with the valve seat, liquid leaving the bottom end of the sleeve is replaced by air entering around the top, allowing quick drainage.

Also shown in FIG. 2 is the preferred configuration of the valve handle and sleeve assembly, wherein sleeve 17 and valve handle 16 are first assembled by means of a pair of sleeve pivot pins 19. The valve handle is then rotated outward so that its pivotal end 34 is toward cap 10, and sleeve 17 is slid onto flow tube 27 while pivotal end 34 engages with stanchion 14 and is axially retained while free to rotate around a transverse axis and to slide transversely to the extent required by the full range of valve operation. Stem 77 is inserted through valve seat 29 and brought into engagement with retainer clip 32 thereby fixing the sleeve in concentric sliding relationship with the flow tube and providing external means for actuating the valve member and for controlling fluid flow. Axial motion of valve member is caused by coaxial motion of the sleeve. Lateral position of valve member with respect to the valve seat is controlled by the tapered shape, self-centering as it is drawn into sealing contact.

Figure 5:
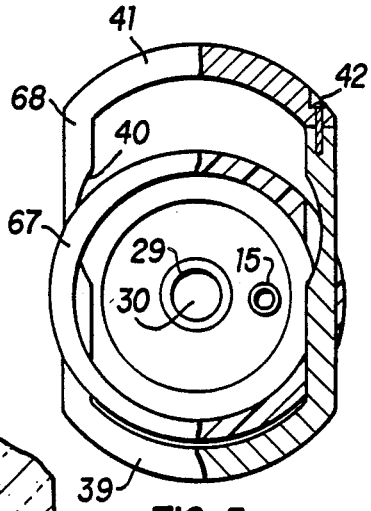
FIG. 5 is a partial section detailing the geometry of the open yoke.

FIG. 5 shows another embodiment of the closure means, with an open yoke 39, legs 68 parallel throughout the operating length, and spaced to straddle neck annulus 20, adapted to slide through parallel transverse holes in cap 67 as shown, and with a circular bore 40 at one end of of yoke travel, corresponding with the cap inside diameter, to admit container mouth 6. An end piece 41 in this embodiment is attached to the yoke ends, allowing assembly of yoke to cap and providing a comfortable surface for closure manipulation.

Figure 6:
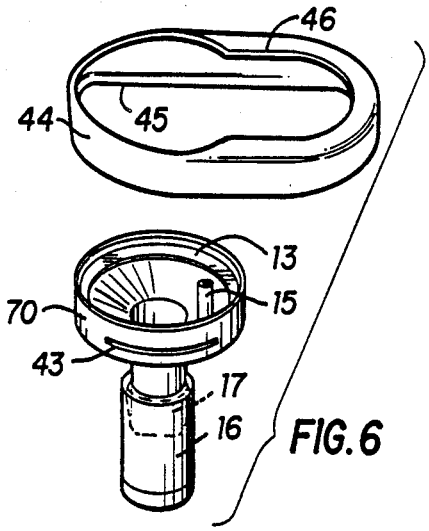
FIG. 6 is a perspective exploded view of the clamping slide with the slotted dispenser cap.

Still another embodiment of this invention is shown by FIG. 6, in which cap 70 mates to mouth 6 through gasket 13, and is pressed to it by clamping slide 44, of C-shaped cross-section, free to slide transversely and remaining affixed to cap 70 at all times by means of an outer lip 45 on each side protruding inward toward the dispenser axis and engaging a parallel pair of transverse grooves on cap 70. The clamping slide has an opening at one end of sufficient diameter to admit mouth 6 into contact with gasket 13, at one extreme of travel. as the clamping slide is moved toward the opposite extreme of its range, annulus 20 is engaged by inner lip 46 on each side, adapted to compress mouth 6 progressively tighter to gasket 13.

FIG. 7 shows means for attachment of the dispenser 1 to container 2 by a closed yoke 11, a rod bent to an elongated closed O-shape, free to slide transversely, with an opening at one end of its travel of sufficient width to admit mouth 6 into contact with gasket 13, the span of opening between its long sides 24 tapering to a reduced width whereby upon movement of closed yoke 11 the sides will constrict around neck 7 at annulus 20 and effectively compress mouth 6 into liquid-tight contact with gasket 13.

The butt ends 47 of closed yoke 11 are left free and unattached for assembly of the yoke to the dispenser cap 10, when the closed yoke 11 must be distorted; then the ends 47 are joined by means of a yoke pin 25 in one end fitting to a socket 26 in the other end, as shown by FIG. 3.

Figure 8:
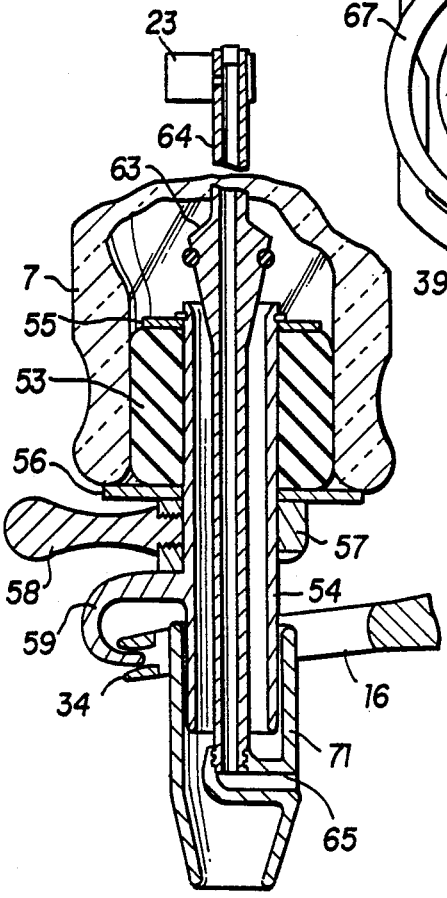
FIG. 8 is a sectional elevation of the embodiment comprising a plug compressed by a helical cam tube.

FIG. 8 discloses an embodiment of this invention in which a resilient plug 53 is sized to slide easily into neck 7 in its undistorted state, then to be compressed longitudinally by means of concentric flow tube 54 with fixed washer 55 at its inner end retaining the inner end of the plug, said flow tube encircled by a helical cam tube 57 below the plug, which cam bears at its lower helical extremity, upon a cam follower 59 which is rigidly fixed to flow tube 54. The upper end of this helical cam tube is flat and perpendicular to its axis, in contact with a concentric flat smooth sliding washer 56 of sufficient diameter to bear against the outer end of plug 53 and against container mouth 6, keeping these two aforementioned parts in relatively identical positions while the plug is compressed by rotary motion of the helical cam tube, effected through the device of cam handle 58. Compression of the plug exerts a radial pressure against the inside of neck 7, serving to seal the container neck against leakage while maintaining a secure grip between dispenser and container.

FIG. 8 also illustrates a variation of this invention wherein vent tube 64 is instrumental in the actuation of the valve member, the vent tube being removably attached at its lower end to sleeve 71 by means of a rigid elbow 65 leading to atmosphere through the sleeve, said vent tube extending effectively upward along the common axis of dispenser and container, to end with check valve 23. At the inner end of flow tube 54 an enlarged portion of the vent tube, called valve head 63, is located so that it will tightly seal against the inner lip of the flow tube when drawn downward by the action of weighted valve handle 16.

Figure 9:
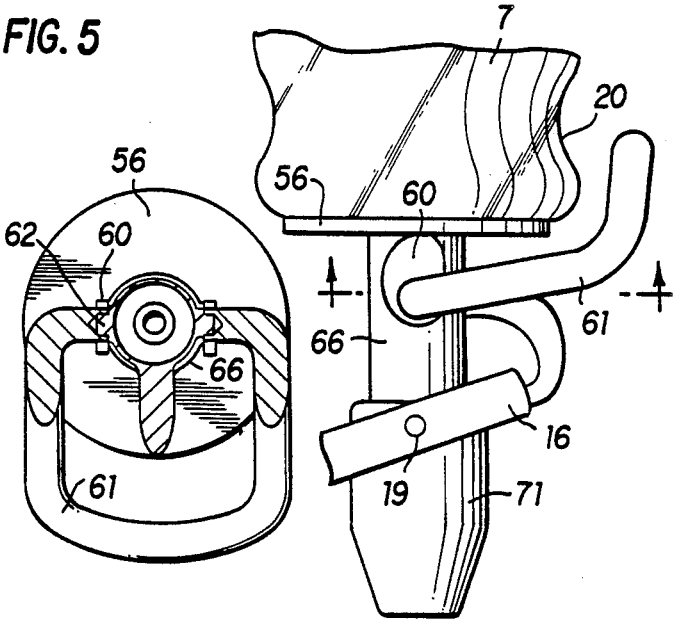
FIG. 9 is an elevation and a cross-section of the embodiment comprising a plug compressed by two eccentric lobes.

FIG. 9 discloses a still further embodiment of this invention wherein the aforementioned plug 53 is compressed in similar fashion by the action of twin eccentric lobes 60, rotating about a pair of lobe pins 62 of common axis, fixed to flow tube 66 perpendicular to the container axis, said lobes urged into engagement with lobe pins by lobe handle 61, a resilient curved member fixed at each end to a lobe, and adapted to rotate two lobes together.

Figure 10:
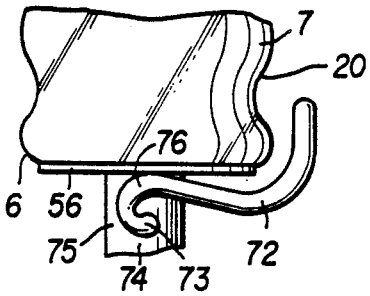
FIG. 10 is a view of the wire compression member.

FIG. 10 shows an embodiment wherein plug compression is accomplished by compression member 72, bent from a length of stiff wire so that the wire ends 73 engage pivotally with a pair of sockets 74, one on each side of flow tube 75, the wire then formed to cam shapes 76, adjacent each socket, adapted to urge said sliding washer 56 against plug 53 upon rotation of compression member 72 around its ends 73.

Figure 11:
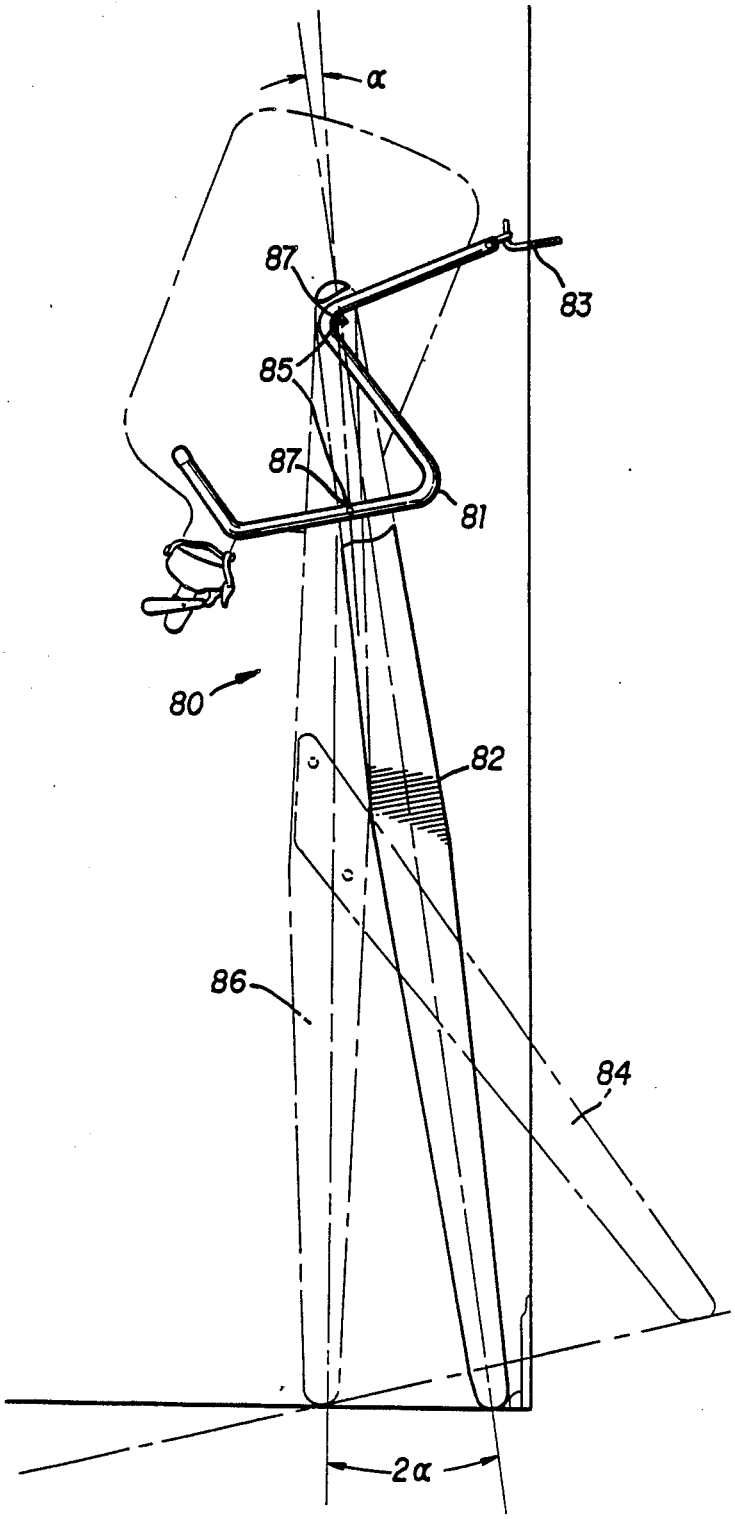
FIG. 11 shows the fluid dispensing apparatus in its wall-supported configuration, with a cutaway portion showing details of reversible fastening means.

FIG. 11 shows a fluid dispensing apparatus 80 in a wall-supported configuration, where container 2 is held inverted at an angle for convenient access to the attached dispenser, by rack 81, itself supported from the floor by stand 82, made up of right and left appendages 86, designated in this configuration by solid lines. The lower end of stand 82 is, in this embodiment of the invention, urged by gravity into contact with floor and wall, and remote from traffic interference. The container is thus supported against a wall and the rack 81 is fixed by tensile attachment means 83, preferably a hook securely fixed to a structural member. Shear force on said attachment means is effectively reduced to zero by the compressive support afforded by stand 82, providing a more predictable and secure wall-mounting means than has heretofore been available for dispensing apparatus.

Figure 12:
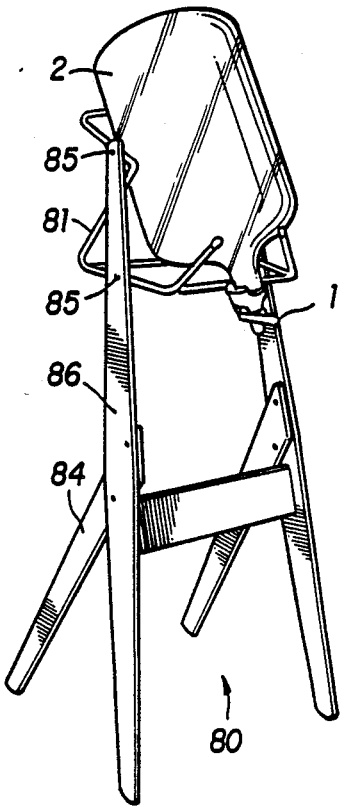
FIG. 12 is a perspective view of the dispensing apparatus in a free-standing configuration.

The free-standing configuration of this invention is also shown, with stand 82 designated by broken lines, superimposed in FIG. 11. The lowermost of fastening points 85 is located some measure off the centerline of appendage 86, so that when rack 81 is released from supporting stand 82 and rotated one-half turn about the vertical axis and before reassembly the rack is swung through a 180 degree angle about its vertical axis, the stand is leaned back and supported by struts 84, which are attached in the free standing configuration and is now independent of attachment means 83. A convenient and comfortable angle is maintained of container 2 and dispenser 1 relative to the floor, as illustrated by FIG. 12, while the weight of the whole is held securely centered.

Lines through pairs of mating attachment points 87 are displaced at an angle (alpha) to the appendage centerline, so that as the rack 81 is released from engagement with the stand 82 and is rotated one-half turn about its vertical axis, and thereafter refixed to the stand, and then the stand is rotated 180 degrees about the vertical axis it may be displaced about the horizontal axis-through twice the aforementioned angle in order to maintain the rack at a fixed angle to the floor. This phenomenon is utilized in the present invention, as shown, as an economical means to maintain an appropriate container angle when converting the fluid dispensing apparatus 80 from wall-supported configuration to a free standing unit.

The foregoing is intended only to illustrate the principles of the invention. Many variations will occur to those skilled in the art; therefore, it is not desired to limit the invention to the exact forms of construction here shown and described, and accordingly all suitable modifications and equivalents may be resorted to, falling within the scope of the invention.

I claim:

1. In combination:

(a) a fluid dispenser comprising an articulable valve member normally biased in the closed position, (b) closure means to secure and seal said dispenser removably to a container having a bottom, wall, mouth, and neck, (c) supporting means to suspend said container securely in an inverted position, allowing access to and manipulation of said dispenser, (d) a vent comprising a vent tube leading from the atmosphere at said dispenser to an interior position near the container bottom, (e) a flow tube, comprising a tubular opening through said closure means to the interior of said container, (f) a coaxial valve seat on the inner wall of said flow tube, (g) a valve member bearing in coaxial sealing contact with said valve seat on the container side of the valve seat, said valve member having diameters in decreasing graduation as it extends outwardly through the valve seat, (h) a stem of lesser cross-sectional area, in coaxial attachment and adapted to actuate said valve member by moving it from sealing contact inwardly, (i) a sleeve, surrounding and extending beyond the outer end of said flow tube and having a common axis therewith, with clearance for air passage between sleeve and flow tube, (j) coupling means interior to said sleeve, to flexibly fasten the outer end of said stem central to the sleeve, allowing resilient angular displacement of stem from the common axis of sleeve and flow tube, (k) operator means adapted to reciprocally actuate said sleeve, comprising a handle pivotally fixed at one end to said closure means, and further fixed in pivotal contact intermediate the ends, on a diametral axis of said sleeve.

2. The combination of claim 1 wherein said closure means comprises:

(a) a cap containing said fluid dispenser, adapted to fit over the neck of said container, (b) a yoke having an comprising a flat loop of substantially rigid material, fixed of said cap in a manner allowing said yoke to slide transversely across the axis of said cap, said yoke opening to sufficient size at one end to admit said neck, and decreasing in width along the length of said yoke so that it will straddle an annulus of reduced diameter on said neck inside the cap, whereby removably sealing said cap to said mouth, said yoke remaining attached as an integral and functional part of said cap.

3. The combination as described in claim 2 wherein said closure means further comprises:

(a) a cylindrical wall on said cap adapted to fit over said neck and containing two parallel openings transverse to the cap axis and equidistant from it, (b) said yoke comprising a U-shaped open rigid member adapted to slide transversely across the cap axis, with two parallel legs spaced to match said parallel openings and to straddle said annulus of reduced diameter in said neck, with leg cross section varied in shape to define said opening to admit said neck, and an end piece adapted to close the open end of said U-shaped yoke upon assembly with said cap to fix the yoke in place as a permanent part of said closure means.

4. The combination as described in claim 2 wherein said yoke comprises a rod, bent to an elongated closed O-shape with long sides parallel and having space between them over part of their length sufficient to admit said neck, the sides then converging and becoming parallel again, with reduced distance of separation substantially corresponding to the least diameter of said annulus, the free ends of said rod joining to form a closed yoke, and wherein said cap contains two pairs of transverse parallel grooves equidistant from the cap axis, spacing between the grooves corresponding to the dimensions separating the sides of said yoke, so that the yoke is guided by said parallel grooves and held in engagement with said cap along the entire range of lateral travel.

5. The combination described in claim 4 wherein said yoke further comprises:

(a) a yoke pin protruding from one end of said rod, and (b) a socket in the other end, congruent in axial position with said yoke pin, so that as the ends are joined said yoke pin engages said socket to prevent relative movement.

6. The combination of claim 1 wherein said supporting means comprises a bracket of more than two support points positioned to hold said container inverted, said support points structurally fixed in a manner which allows an unobstructed lateral path for the insertion, use, and removal of said container, neck down, with said dispenser attached.

7. The combination of claim 6 wherein said bracket is adapted to be securely fastened to a vertical wall.

8. The combination of claim 6 wherein said bracket comprises two symmetrical elongated container cradling support members fixed near the bottom of a vertically oriented base, and extending laterally from the base, one member to each side of said neck, to contact and support the container at points outside the container center of gravity from the base, then curving upward and outward, one to each side of the container wall and back to the base where the members are fixed securely at an elevation substantially above the neck.

9. The combination of claim 1 wherein said closure means comprises:

(a) a cap adapted to make sealing contact with said mouth, (b) an elastomeric gasket adapted to fit between cap and mouth, (c) a clamping slide engaged with opposite edges of said cap, and adapted to move across the neck axis from one extreme position where the mouth is free to pass into contact with said gasket toward the opposite position where said clamping slide embraces the neck at an annulus of reduced diameter, points of contact between the slide and the neck so positioned by design, that further transverse movement of the slide after initial contact with the neck urges said mouth into tighter sealing proximity with said gasket.

10. In combination:

(a) a fluid dispenser comprising an articulable valve member normally biased in the closed position, (b) closure means to secure and seal said dispenser removably to a container having a bottom, wall, mouth and neck, (c) a vent comprising a vent tube leading from the atmosphere at said dispenser to an interior position, permitting entry of air to replace dispensed fluid, (d) a flow tube passing through said closure means, to the interior of said container, (e) a coaxial valve seat on the inner wall of said flow tube, (f) a valve member adapted to bear in sealing contact with said valve seat, (g) a stem with circumferential groove, centrally and coaxially attached to said valve member and extending through and beyond said valve seat, (h) a sleeve, surrounding and coaxial with said flow tube, said sleeve comprising a portion of cylindrical wall adapted to slide freely over the flow tube, (i) a resilient retainer clip fixed to the inner wall of said sleeve and adapted to retain said stem central to the sleeve diameter, the shape of said retainer clip adapted to allow the stem to pass axially adjacent and be forced laterally into engagement, said retainer clip then straddling the stem at said circumferential groove.

11. In combination:

(a) a fluid dispenser comprising an articulable valve member normally biased in the closed position, (b) closure means to secure and seal said dispenser removeably to a container having a bottom, wall, mouth and neck, comprising a cap held in sealing contact with said mouth by means of:

a clasp of U-shape, pivotally attached at the base of the U on a transverse axis to one edge of said cap and shaped to engage said neck at an annulus of reduced diameter, the free ends of said clasp adapted to extend laterally beyond the area of contact with said neck, a bail comprising moveable means for constraining said free ends and preventing lateral spread, one from the other, while providing secure axial purchase, an over-center clip supporting said bail and attached pivotally to said cap opposite the pivot axis of the clasp, two ends of said clasp adapted to be brought together and constrained by said bail, and drawn tight by over-center rotation of said over-center clip, effecting a sealing contact between cap and mouth.

12. A fluid dispensing apparatus comprising:

a container having a bottom, wall, mouth and neck, a dispenser removably attached in sealing contact with said mouth, a rack adapted to support said container, neck down and angled from the vertical, a stand adapted to support said rack, said stand comprising:

(a) a pair of elongated appendages, left- and right-hand, removably fixed to said rack as a means of support at an elevation from the floor, (b) means to allow assembly of rack to stand in either of two relationships while effectively holding fixed the angle of said rack to the floor, in one of said two relationships said appendages are leaned forward off the vertical, while in the opposite of said two relationships said appendages are back off the vertical from points of appendage to floor contact, (c) attachment means to removably fix said rack, when assembled with said appendages in the relationship causing it to lean forward off the vertical, to a vertical wall, suspending the mass center of said container off the vertical from the lower end of said stand, (d) a pair of struts removably fixed to said elongated vertical appendages, one to each, when said rack is assembled to said stand in the relationship opposite to that referred to in (c) above, said struts shaped and positioned to cause stable support, holding the mass center of said container central to points of base contact.

* * * * *